United States Patent [19]

Marchal

[11] 4,253,246

[45] Mar. 3, 1981

[54] INSTALLATIONS FOR THE TREATMENT OF STRIP MATERIAL IN A GASEOUS MEDIUM

[75] Inventor: Paul Marchal, Garches, France

[73] Assignee: Air Industrie, Garches, France

[21] Appl. No.: 60,763

[22] Filed: Jul. 26, 1979

[30] Foreign Application Priority Data

Aug. 1, 1978 [FR] France ..... 78 22742

[51] Int. Cl.[3] ..... F26B 13/08

[52] U.S. Cl. ..... 34/121; 34/156; 34/159; 198/781; 198/789; 192/45

[58] Field of Search ..... 192/45; 29/115; 34/156, 34/121, 15 A, 116, 117; 198/790, 781, 783, 789, 791

[56] References Cited

U.S. PATENT DOCUMENTS

| | | | |
|---|---|---|---|
| 2,001,668 | 5/1935 | Maier | 192/45 |
| 2,812,594 | 11/1957 | Lamason | 34/121 |
| 3,085,346 | 4/1963 | Auander et al. | 34/156 |
| 3,265,267 | 8/1966 | Wallin | 34/159 |
| 3,561,134 | 2/1971 | Kruckels et al. | 34/121 |
| 3,986,273 | 10/1976 | Fuhring et al. | 34/156 |

FOREIGN PATENT DOCUMENTS

| | | |
|---|---|---|
| 1285989 | 1/1962 | France . |
| 1598722 | 7/1970 | France . |

*Primary Examiner*—Larry I. Schwartz

*Attorney, Agent, or Firm*—Larson, Taylor and Hinds

[57] ABSTRACT

The invention relates to installations for the treatment in a gaseous medium of a strip material passing over rollers (6).

Each roller (6) is driven in rotation by an endless belt (10) serving also for the embarkment of the strip, this endless belt passing over drive pulleys (15) which drive the corresponding roller (6) by coupling means (101) ensuring a "free wheel" function and a "coupler" function.

The installation is useful for the heat treatment, especially the drying of a strip material.

9 Claims, 4 Drawing Figures

108
101
106
107
109
105
10
15
6
103
102
104
13
9
7
8

101
108
107
106
105
109
10
15
6
10
15
103
102
104
13
9
7
8

INSTALLATIONS FOR THE TREATMENT OF STRIP MATERIAL IN A GASEOUS MEDIUM

The invention relates to installations for the treatment in a gaseous medium, notably for heat treatment, of a strip material.

Such an installation comprises a plurality of treatment zones in which the strip material is supported by the aerodynamic effect of several gas discharges coming from holes in opposite walls of caissons arranged on each side of the treatment zone.

These treatment zones are generally arranged parallel to one another and in a horizontal arrangement thus forming treatment zone stages.

In any case, return rollers are provided to support the strip material during its travel between the treatment zones; the strip hence passes from the exit of one treatment zone to the entrance of the following treatment zone, these passages being effected in the form of a half-turn around a return roller if the treatment zones are arranged in stages.

When the installation is in operation, the strip material is extracted from the installation by an extractor mechanism generally constituted by two pressure rollers between which the strip material passes, at least one of these pressure rollers being driven in rotation by drive means.

When putting the installation into operation, it is necessary, on the one hand to guide and route the strip material from its entry into the first treatment zone up to its exit from the last treatment zone where said strip is then taken over by the extractor mechanism, and on the other hand, to drive in rotation the return rollers in order that this driving should not be through the strip material in the course of its introduction into the installation.

The guidance and routing of the strip material on starting up the operation of the installation is effected through at least one endless belt set in motion by drive means and drawing the strip by means of a gripping device fixed to this endless belt to catch (before the first treatment zone) and release (after the last treatment zone) the end of the strip.

The driving in rotation of the return rollers on the setting in operation of the installation is effected through as many driving pulleys, of the same initial diameter as the return rollers and over which the endless belt passes, as there are return rollers to be driven, coupling means being interposed between each drive pulley and the corresponding return roller.

It is known that in such installations, problems are encountered in the realization of these coupling means.

In fact, during the period of setting the installation in operation, problems of two types are met:

on the one hand, the strip material may undergo a longitudinal shrinkage during its travel through the installation, notably where heat treatment is concerned; failing special precautions, the strip runs the risk of being torn more particularly when it passes over the return rollers, and, on the other hand, the endless belt must, at the moment of starting it up, drive all of the return rollers; failing special precautions, one is then led to provide oversized drive means to ensure the starting up of the endless belt, as well as a cross-section of this endless belt which withstands the traction imposed on it by the opposing torque at the moment of starting up.

It is an object of the present invention to overcome the drawbacks resulting from these two problems.

It is an object of the invention to provide an installation in which the design of the coupling means enables, on the one hand, any risk of tearing of the strip material when there is longitudinal shrinkage to be avoided, and on the other hand, recourse to endless belt entraining drive means which are much smaller and capable of reducing to a very considerable extent the traction forces undergone by the endless belt, and hence its cross-section.

According to the invention, these coupling means, interposed between each drive pulley and the corresponding return roller, are arranged to ensure "free wheel" operation (so that each roller can rotate faster than the corresponding drive pulley) and a "coupling function" (so that each roller is driven progressively by the corresponding drive pulley).

Preferably, the "coupling" function is ensured adjustably, so that the time of setting up the speed of each return roller is adapted to the location of the return roller concerned in the installation, that is to say adapted to the time interval which separates the moment when the gripping device has fastened the end of the strip material to the moment when the gripping device passes over the roller concerned.

In a first embodiment, the coupling means are constituted by the association of a free wheel device and a coupler device.

This free wheel device and this coupler device may be arranged so that, between the drive pulley and the return roller concerned, either, the free wheel and then the coupler device are successively encountered, or, the coupler device and then the free wheel device are successively encountered.

In another embodiment, the coupling means are constituted by a single mechanical assembly enclosing a free wheel and a coupler of which certain parts may be combined.

This mechanical assembly can be arranged so that the transmission between the drive pulley and the corresponding return roller is effected, either, by first encountering the free wheel and then the coupler, or, by first encountering the coupler and then the free wheel.

The invention consists, apart from the features which have just been considered, of certain other features which are utilized preferably at the same time and which will be more explicitly considered below.

The invention will, in any case, be well understood by means of the additional description which follows as well as the accompanying drawings, which description and drawings relate to preferred embodiments of the invention not implying any limiting character.

FIG. 1, of these drawings, is a diagrammatic section of an installation according to the invention, the various elements of this installation being shown in the position that they occupy before the introduction of the strip material to be treated in the installation.

Figure 1:
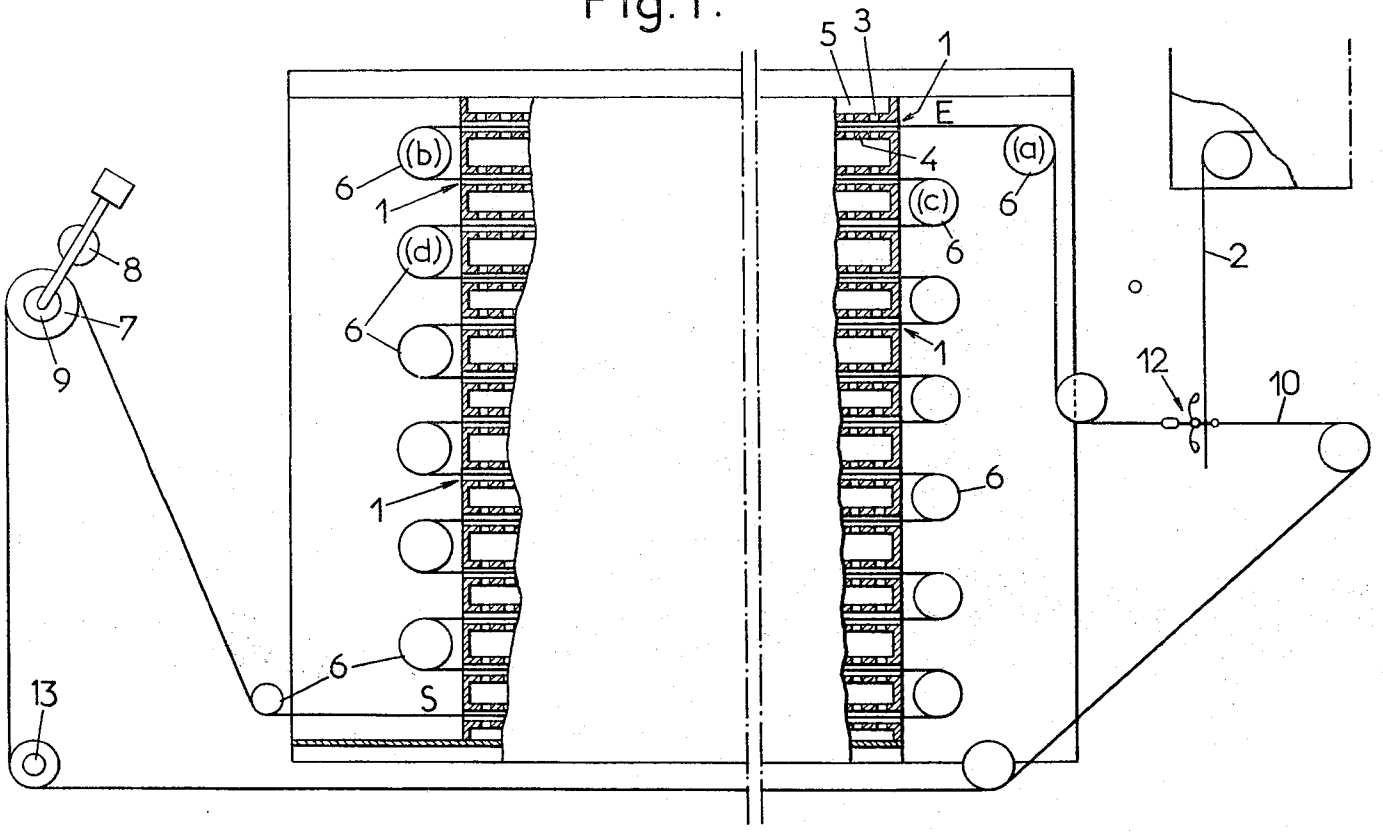
Figure 2:
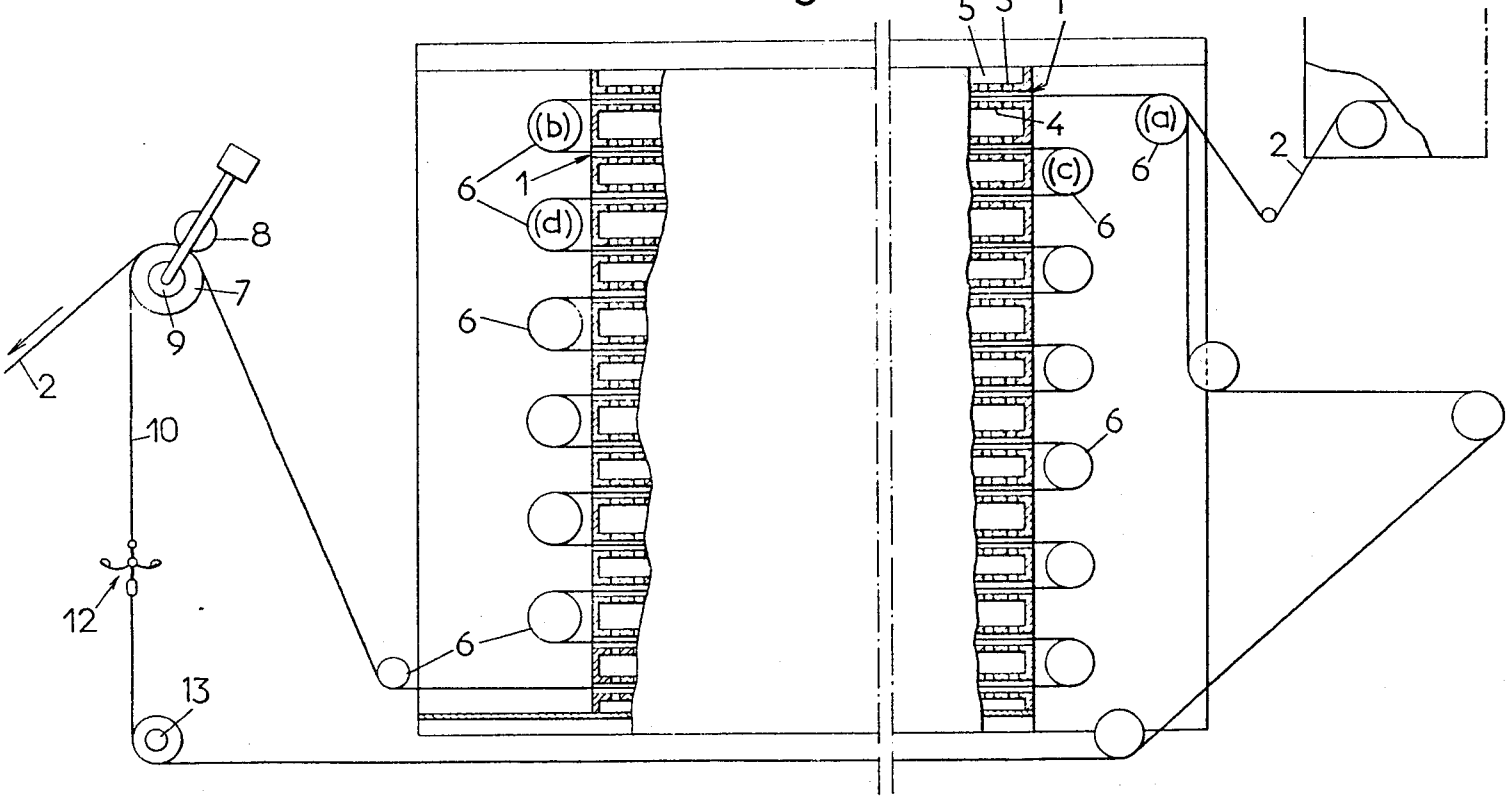
FIG. 2 shows, under the same conditions, the installation shown in FIG. 1, but the various elements of this installation are shown in the position that they occupy once the strip material has been introduced into the installation.

The installation, as shown in FIGS. 1 and 2, is an installation for the heat treatment (notably the drying) of a strip material.

This installation includes a plurality of treatment zones 1, parallel to one another and in which the strip material 2 is supported by the aerodynamic effect of several discharges of hot gas emerging from holes 3 formed in the opposed walls 4 of caissons 5 arranged on both sides of each of said treatment zones 1.

These treatment zones 1 are generally arranged horizontally and thus form treatment zone stages.

In any case, the return rollers 6 are provided to support the strip material 2 during its routing between the treatment zones 1; the strip 2 hence passes from the exit of one treatment zone 1 to the entrance of the following treatment zone 1, these passages being effected in the form of a half-turn around a return roller 6 if the said treatment zones are arranged in stages.

When the installation is in operation, the strip material is extracted from the installation by an extractor mechanism generally constituted by two presser rollers 7 and 8 between which the abovesaid strip 2 passes, one at least of these presser rollers, for example the presser roller 7, being driven in rotation by drive means 9.

For placing the installation in operation, it is necessary, on the one hand, to guide and route the strip material 2 from its entrance E into the first treatment zone 1 up to the exit S from the last treatment zone 1 where said strip 2 is then taken over by the extractor mechanism 7, 8 driven by the drive means 9, and on the other hand, to drive in rotation the return rollers 6 in order that this driving should not be done through the strip material 2 in the course of introduction into the installation.

The guiding and routing of the strip material 2 on the placing of operation of the installation is effected through an endless belt 10, set in motion by drive means 13 synchronized with drive means 9, so that after its setting up at speed the endless belt 10 has the same peripheral speed as the presser roller 7 of the extractor mechanism. These drive means 13 draw the strip 2 by means of a gripping device 12 fixed to this endless belt 10 to engage (before the first treatment zone 1) and disengage (after the last treatment zone 1) the end of the strip 2.

Figure 3:
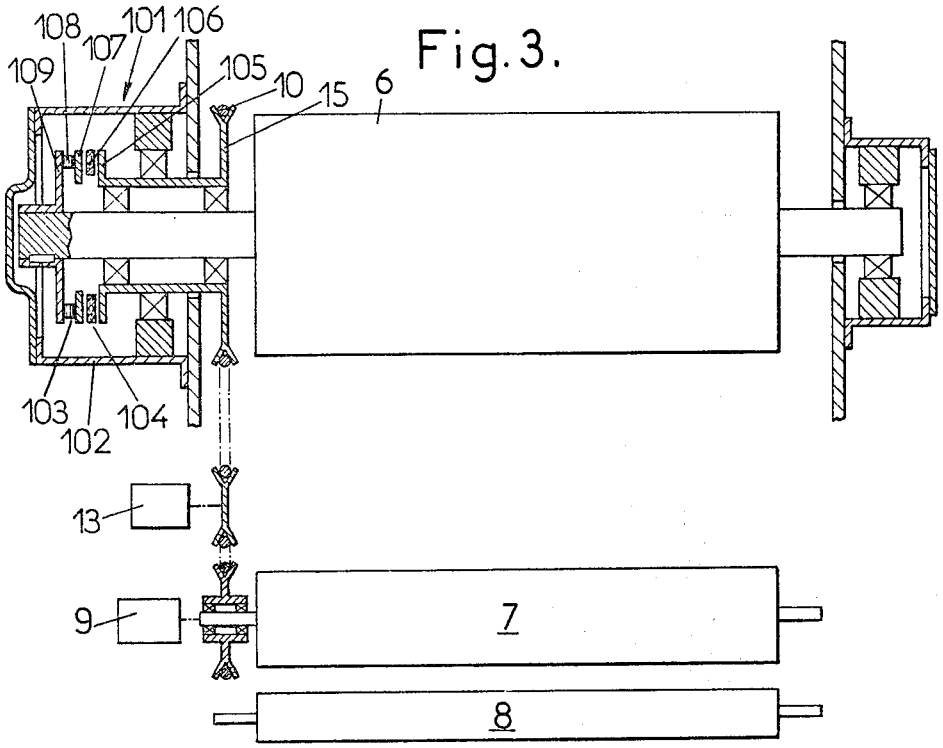
FIG. 3 shows, in section, through a vertical plane passing through the axis of any one of the return rollers of the installation shown in FIGS. 1 and 2, the coupling means between each drive pulley and the corresponding return roller, the installation being of the type with lateral introduction of the strip material.
Figure 4:
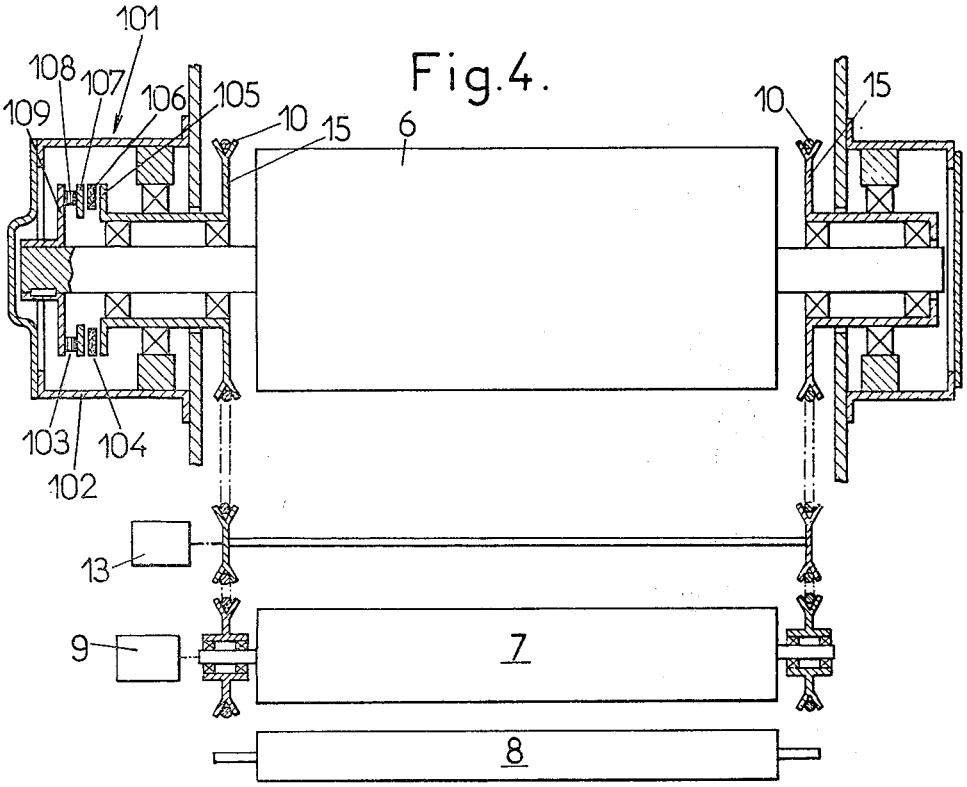
FIG. 4 shows, in section, through a vertical plane passing through the axis of any one of the return rollers of the installation shown in FIGS. 1 and 2, the coupling means between each drive pulley and the corresponding return roller, the installation being of the type with central introduction of the strip material.

The driving in rotation of the return rollers 6 on the placing of the installation in operation is effected through as many drive pulleys 15 over which the endless belt 10 passes as there are return rollers 6 to be driven, coupling means 101 being interposed between each drive pulley 15 and the corresponding return rollers 6; of course, these drive pulleys 15 have the same initial diameter as the return rollers 6 (FIGS. 3 and 4).

These coupling means 101, interposed between each drive pulley 15 and the corresponding return roller 6, are arranged to ensure a double function, namely, a "free wheel" function giving the possibility to each return roller 6 of being able to rotate faster than the corresponding drive pulley 15, which permits the peripheral speed of each return roller 6 to be equal to the passing speed of the endless belt 10, whilst permitting this peripheral speed of each return roller 6 to become greater than the passing speed of the endless belt 10 under the effect of longitudinal shrinkage of the strip 2, and a "coupler" function giving the possibility to each return roller 6 of being able to be driven progressively by the corresponding drive pulley 15, which permits the size of the drive means 13 placing the endless belt 10 in motion to be reduced and the cross-section of the endless belt 10 to be reduced since the traction imposed on it by the opposing torque at the moment of starting up is found to be considerably reduced by the slippage permitted by this "coupler" function.

Preferably, the "coupler" function is ensured adjustably, so that the time of setting up the speed of each return roller 6 is adapted to the position of the return roller 6 concerned in the installation.

In other words, the "coupler" function may be adapted to the time interval which separates the moment when the gripping device 12 has engaged the end of the strip 2 from the moment when the gripping device 12 passes over the roller concerned.

In practice, this result is achieved by a relatively limited number of different adjustments.

For example, the adjustment of the "coupler" function of the coupling means 101 of the first return roller 6 (marked a) may be such that the establishment of the speed of said return roller is ensured in about two seconds, if it needs more than two seconds for the gripping device 12 to reach this roller **6*a*** from its starting position.

For the second return roller 6 (marked b), the adjustment of the "coupler" function of the coupling means 101 of said return roller could then be such that the establishment of the speed of this return roller is ensured in about 20 seconds if it needs more than 20 seconds for the gripping device 12 to reach this roller **6*b*** from its starting position.

For the other return rollers 6 (marked c, d, etc.) one may continue to increase the time of establishing the speed of the latter by adjustment of the "coupler" function of their coupling means 101 insofar as this time is still less than the time taken by the gripping device 12 to reach said rollers.

Although it is possible, as indicated previously, to constitute the coupling means 101 by the association of a free wheel device and a coupler device, it seems that there is reason to give preference to the embodiment illustrated in FIGS. 3 and 4 which relate, the one, (FIG. 3), to an installation with lateral introduction, and, the other (FIG. 4), to an installation with central introduction.

According to this embodiment, these coupling means 101 are constituted by a single mechanical assembly 102 enclosing a free wheel 103 and a coupler 104.

Generally, the coupling means 101 may be arranged so that the transmission between the drive pulley 15 and the corresponding return roller 6 is effected, either, by encountering first the free wheel 103 (or the free wheel device), and then the coupler 104 (or the coupler device), or, by encountering first the coupler 104 (or the coupler device, and then the free wheel 103 (or the free wheel device).

The mechanical assembly 102 may advantageously be constructed so that certain parts of the free wheel 103 are combined with certain parts of the coupler 104. On this subject, it is possible to resort to the embodiment illustrated in FIGS. 3 and 4 and according to which reliance is placed on a free wheel 103 with a roll or with a roller and with a friction coupler 104.

The mechanical assembly 102 is then constructed so that the transmission is effected first through the coupler 104 and then through the free wheel 103.

The coupler 104 includes a driving plate 105, friction linings 106 and a driven plate 107.

The free wheel 103 may then include rolls or rollers 108 inserted between a driven plate 109 and a driving plate which may be constituted by the driven plate 107 of the coupler 104.

It would also be possible to resort to a mechanical assembly 102 constituted by a free wheel clutch device such as that described in French Pat. No. 1,285,989 and its First Certificate of Addition No. 81,683, filed respectively on Jan. 17, 1961 and May 21, 1962, by Madame NICOT, née Georgette VOILLOT, for "Free wheel clutch".

As regards the installation as a whole, it may be indicated that it is particularly advantageous to resort to single drive means replacing the drive means 9 of the extractor mechanism and the drive means 13 of the endless belt 10.

The single drive means (not shown) would then include a clutch device enabling the driving of the endless belt 10 from its placing in operation by the introduction of the strip material, whilst they would drive the extractor mechanism constantly, the assembly then being designed so that after its setting up in speed through the clutch the endless belt 10 has the same peripheral speed as the presser roller 7 of the extractor mechanism.

As for the rest of the installation, it may advantageously be constructed as indicated in French Pat. No. 1,598,722, filed Dec. 24, 1968 by the TUNZINI AMELIORAIR Company for "Improvements in or to installations for the treatment in a gaseous medium of strip materials" and assigned to Applicant.

Accordingly and whatever the embodiment adopted, there is provided an installation which has a certain number of advantages which are summarized below:

the assembly of the coupling means ensuring the "free wheel" function and the "coupler" function enables the transmission of an adjustable constant torque to the return rollers;

on the starting-up of the endless belt, this adjustable constant torque enables the progressive placing in rotation of the assembly of return rollers until synchronization is reached between the passage speed of the endless belt and the peripheral speed of each return roller, this synchronization being reached in a time which depends on the adjustment of the "coupler" function and of the inertia of the return roller driven;

moreover, after the synchronization between the return roller and the endless belt is reached, each return roller may, due to its "free wheel" function, be driven freely at an over-speed with respect to the endless belt as soon as the return roller is pulled at its periphery by tension of the strip material caused by shrinkage;

lastly, each return roller may be driven freely by the strip material, once the introduction of this strip material is effected, that is to say, once that the endless belt, and hence the included drive pulleys, is stopped.

This group of advantages enables, with respect to known devices, the realization of the introduction of the material with single drive means of much lower power.

It enables also a considerable reduction in the size and the strength required in the endless introduction belt, due to the considerable reduction in the forces imposed on the latter during the operation of introduction.

Consequently, it enables the speeds of introduction and the width of the latter to be considerably increased.

As is self-evident, and as emerges already from the foregoing, the invention is in no way limited to those of its methods of application and embodiments which have been more particularly envisaged; it encompasses, on the contrary, all modifications.

I claim:

1. Installation for the treatment in a gaseous medium, notably for heat treatment, of a strip material comprising:

(a) a plurality of treatment zones in which the strip material is supported by an aerodynamic effect;

(b) a plurality of return rollers over which the strip material passes;

(c) at least one endless belt driving the strip during its introduction into the installation, this endless belt being set in motion by drive means;

(d) as many drive pulleys as there are return rollers, these drive pulleys having the same initial diameter as the return rollers, said endless belt passing over said drive pulleys;

(e) free wheel means interposed between each drive pulley and the corresponding return roller so that each return roller can rotate faster than the corresponding drive pulley; and (f) sliding coupler means interposed between each driver pulley and its corresponding return roller, said sliding coupler means being constructed such that each return roller is progressively driven by its corresponding drive pulley.

2. Installation according to claim 1, in which the sliding effect of the sliding coupler means is adjustable such that the time until starting of each return roller is dependent upon the location of the return roller concerned in the installation.

3. Installation according to claim 1 or 2, in which the coupling means are constituted by the association of a free wheel device and a coupler device.

4. Installation according to claim 3, in which the free wheel device and the coupler device are encountered successively between the drive pulley and the corresponding return roller.

5. Installation according to claim 3, in which the coupler device and the free wheel device are encountered successively between the drive pulley and the corresponding return roller.

6. Installation according to claim 1 or 2, in which the coupling means are constituted by a single device enclosing a free wheel and a coupler.

7. Installation according to claim 6, in which this single device is constructed so that certain of its parts at least are common between the free wheel and the coupler.

8. Installation according to claim 6, in which the single device is arranged so that the transmission between the drive pulley and the corresponding return roller is effected by encountering first the free wheel and then the coupler.

9. Installation according to claim 6, in which the single device is arranged so that the transmission between the drive pulley and the corresponding return roller is effected by encountering first the coupler and then the free wheel.

* * * * *